US007071887B2

(12) United States Patent
Shigihara et al.

(10) Patent No.: US 7,071,887 B2
(45) Date of Patent: Jul. 4, 2006

(54) ANTENNA DEVICE CAPABLE OF BEING TUNED IN WIDE BAND

(75) Inventors: Makoto Shigihara, Fukushima-ken (JP); Yusuke Nakamura, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/040,374

(22) Filed: Jan. 21, 2005

(65) Prior Publication Data

US 2005/0162323 A1 Jul. 28, 2005

(30) Foreign Application Priority Data

Jan. 26, 2004 (JP) ..... 2004-016670

(51) Int. Cl.
*H01Q 11/12* (2006.01)

(52) U.S. Cl. ..... 343/744; 343/787; 343/895

(58) Field of Classification Search ..... 343/744, 343/787, 869, 895
See application file for complete search history.

(56) References Cited

U.S. PATENT DOCUMENTS 3,427,624 A 2/1969 Wanselow et al. ..... 343/750
3,573,840 A 4/1971 Gouillou et al. ..... 343/895
3,946,397 A 3/1976 Irwin ..... 343/748
4,873,527 A * 10/1989 Tan ..... 343/718

FOREIGN PATENT DOCUMENTS

JP 51-83755 7/1976
JP 2003-318636 11/2003

* cited by examiner

*Primary Examiner*—Shih-Chao Chen
(74) *Attorney, Agent, or Firm*—Joseph A. Calvaruso; Chadbourne & Parke LLP

(57) ABSTRACT

The present invention provides an antenna device capable of automatically obtaining excellent receiving sensitivity over a wide band. The antenna device comprises a rod-shaped base made of a dielectric material or a magnetic material; a stripe-shape radiating conductor divided into a plurality of radiating conductors wound around the base; and variable capacitive elements provided to correnspond to the same number of the radiating conductors. The radiating conductors and the variable capacitive elements are alternatively arranged on the base and are connected in series to each other, the radiating conductor having its one end connected to the variable capacitive element serves as an opening side and the variable capacitive element having its one end connected to the radiating conductor serves as a signal feeding side, and capacitance values of the variable capacitive elements increase or decrease in the same direction to be tuned to a predetermined frequency.

7 Claims, 3 Drawing Sheets

ANTENNA DEVICE CAPABLE OF BEING TUNED IN WIDE BAND

BACKGROUND OF THE INVENTION

1. Field of the Invention

The present invention relates to an antenna device capable of being tuned in a wide band of frequency.

2. Description of the Related Art

A conventional antenna device 10 will be described with reference to FIGS. 6 and 7. A thin metallic strip type of spiral conductor 12 is wound around a ferrite magnetic core 14. Connection terminals 16 and 18 are formed at ends of the spiral conductor 12. The spiral conductor 12 is cut to be divided into a plurality of conductor pieces 12' and the plurality of conductor pieces 12' is connected to each other by a plurality of capacitive elements 20. As shown in FIG. 7, the antenna device 10 is one in which the capacitive elements 20 are physically distributed in the spiral conductor 12 to constitute a closed loop, and responds to a specific frequency (for example, Japanese Unexamined Patent Application Publication No. 51-83755 (FIGS. 1 and 3)).

However, according to the conventional antenna device, since the conventional antenna device is resonated with a specific frequency, the receiving sensitivity becomes lowered at a frequency other than the specific frequency when being received over a wide band.

SUMMARY OF THE INVENTION

Accordingly, the present invention has been made to solve the above-mentioned problems, and it is an object of the present invention to provide an antenna device capable of automatically obtaining excellent receiving sensitivity over a wide band.

In order to solve the above-mentioned problems, according to a first aspect of the present invention, there is provided an antenna device which comprises a rod-shaped base made of a dielectric material or a magnetic material; a stripe-shape radiating conductor divided into a plurality of radiating conductors wound around the base; and variable capacitive elements provided to correspond to the same number of the radiating conductors. The radiating conductors and the variable capacitive elements are alternatively arranged on the base and are connected in series to each other, the radiating conductor having its one end connected to the variable capacitive element serves as an opening side and the variable capacitive element having its one end connected to the radiating conductor serves as a signal feeding side, and capacitance values of the variable capacitive elements increase or decrease in the same direction.

According to a second aspect of the present invention, the base has a prism shape, and the variable capacitive elements are provided on the same side of the base.

According to a third aspect of the present invention, wherein the variable capacitive element has a varactor diode, a first electrode serving as a ground, a second electrode to which a tuning voltage is applied, and a third electrode for supplying a signal are provided on a circumferential portion of the same side of the base, an anode of the varactor diode is connected to the first electrode via a first resistor, a cathode of the varactor diode is connected to the second electrode via a second resistor, the varactor diode has one end of its feeding side connected to the radiating conductor while the other end of the feeding side is connected to the third electrode, and the first and second resistors are provided on the same side of the base.

According to a fourth aspect of the present invention, an impedance matching circuit is provided between the third electrode and the other end of the feeding side of the varactor diode.

According to a fifth aspect of the present invention, the anodes and cathodes of two varactor diodes are connected in common to the radiating conductor, a central point of the radiating conductor connected in common to the anodes is connected to the first electrode via the first resistor, and a central point of the radiating conductor connected in common to the cathodes is connected to the second electrode via the second resistor.

According to a six aspect of the present invention, the impedance matching circuit has at least the capacitive element provided on the same side of the base, and the capacitive element is connected between the first and third electrodes.

According to a seventh aspect of the present invention, the number of the radiating conductors is six.

According to the present invention, the radiating conductors and the variable capacitive elements are alternatively arranged on the base and are connected in series to each other, the radiating conductor having its one end connected to the variable capacitive element serves as an opening side and the variable capacitive element having its one end connected to the radiating conductor serves as a signal feeding side, and capacitance values of the variable capacitive elements increase or decrease in the same direction. Therefore, the location at which the electric field becomes the smallest is moved on the base by the capacitance value of the variable capacitive element, the value of the electric field between the location at which the electric field becomes the smallest and the location of the releasing end becomes the greatest at the releasing end. In addition, since the electric field is hardly generated at the locations from the location at which the electric field becomes the smallest to the feeding end, the antenna device performs the same operation as a monopole antenna. In addition, it is possible to achieve the antenna device capable of having a small size and automatically obtaining excellent receiving sensitivity over a wide band.

Further, according to the preset invention, the base has a prism shape, and the variable capacitive elements are provided on the same side of the base. Therefore, it is possible to manufacture the antenna device with ease.

Further, according to the present invention, the variable capacitive element has a varactor diode, a first electrode serving as a ground, a second electrode to which a tuning voltage is applied, and a third electrode for supplying a signal are provided on a circumferential portion of the same side of the base, an anode of the varactor diode is connected to the first electrode via a first resistor, a cathode of the varactor diode is connected to the second electrode via a second resistor, the varactor diode has one end of its feeding side connected to the radiating conductor while the other end of the feeding side is connected to the third electrode, and the first and second resistors are provided on the same side of the base. Therefore, it is possible to achieve the antenna device which can be easily connected to the circuit board constituting the receiving circuit.

Furthermore, according to the present invention, an impedance matching circuit is provided between the third electrode and the other end of the feeding side of the varactor diode. Therefore, the circuit substrate is simple in structure, small in size and low in cost.

Further, according to the present invention, the anodes and cathodes of two varactor diodes are connected in common to the radiating conductor, a central point of the radiating conductor connected in common to the anodes is connected to the first electrode via the first resistor, and a central point of the radiating conductor connected in common to the cathodes is connected to the second electrode via the second resistor. Therefore, a feeding circuit for supplying the tuning voltage to the varactor diode is simple in structure.

Further, according to the present invention, the impedance matching circuit has at least the capacitive element provided on the same side of the base, and the capacitive element is connected between the first and third electrodes. Therefore, the circuit substrate is simple in structure, small in size and low in cost.

Furthermore, according to the present invention, the number of the radiating conductors is six. Therefore, it is possible to achieve an antenna device which is suitable for receiving the television signal of an UHF body at band of from 470 MHz to 770 MHz.

DESCRIPTION OF THE PREFERRED EMBODIMENTS

Hereinafter, an antenna device of the present invention will be described with reference to FIGS. 1 to 5. First, in FIG. 1, a stripe-shaped radiating conductor 22 is wounded on a prism base 21 that is made of a dielectric material or a magnetic material. The radiating conductor 22 is divided into six radiating conductors 22*a* to 22*f*. The radiating conductor 22 and varactor diodes 23 (23*a* to 23*f*) which are the same number as the radiating conductors 22 and serves as a variable capacitive element are alternately arranged and are connected in series to each other.

Figure 1:
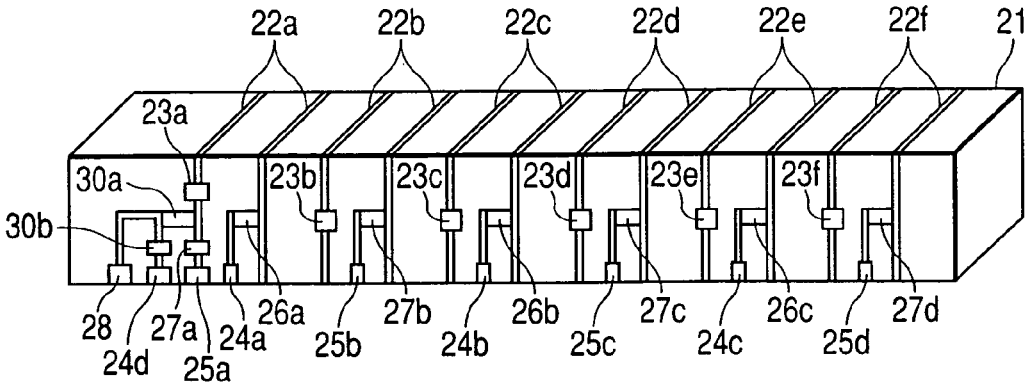
FIG. 1 is a perspective diagram of an antenna device of the present invention.
Figure 2:
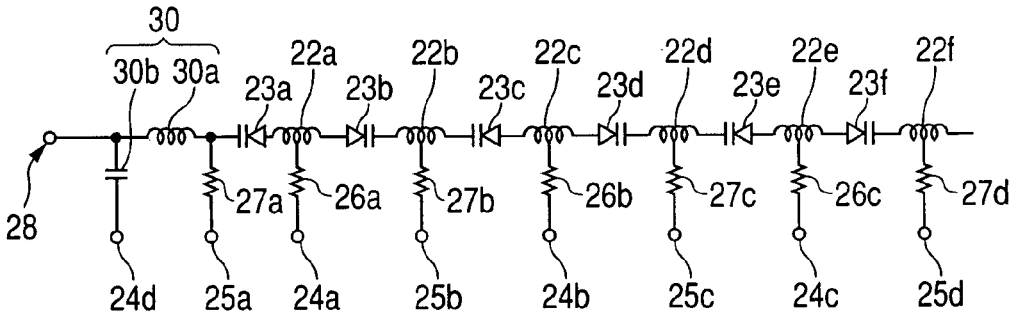
FIG. 2 is an equivalent circuit diagram of the antenna device of the present invention.

In other words, the radiating conductor 22*a* is connected between the varactor diodes 23*a* and 23*b*, and the radiating conductor 22*b* is connected between the varactor diodes 23*b* and 23*c*. This relationship is to be continued and thus the varactor diode 23*f* is finally connected between the radiating conductors 22*e* and 22*f*. However, as shown in FIG. 2, in order that the adjacent varactor diodes have the polarities opposite to each other, the radiating conductor 22*a* is connected between anodes of the varactor diodes 23*a* and 23*b* located at a feeding end side, the radiating conductor 22*b* is connected between cathodes of the varactor diodes 23*b* and 23*c*, the radiating conductor 22*c* is connected between anodes of the varactor diodes 23*c* and 23*d*, the radiating conductor 22*d* is connected between cathodes of the varactor diodes 23*d* and 23*e*, and the radiating conductor 22*e* is connected between anodes of the varactor diodes 23*e* and 23*f*. In addition, the radiating conductor 22*f* connected to the cathode of the varactor diode 23*f* serves as a releasing end. In addition, the varactor diode 23 is provided on one side of the base 21.

In addition, on the one side of the base 21, a first electrode 24 (24*a* to 24*c*) for connecting the anode of the varactor diode 23 to a ground is formed and a second electrode 25 (25*a* to 25*d*) for applying a tuning voltage to the cathode of the varactor diode 23 is formed. In addition, substantially central portions of the radiating conductors 22*a*, 22*c*, and 22*e* are connected to the first electrodes 24*a*, 24*b*, and 24*c* via a resistor 26 (26*a*, 26*b*, and 26*c*), respectively. In addition, the cathode of the varactor diode 23*a* and substantially central portions of the radiating conductors 22*b*, 22*d*, and 22*f* are connected to the second electrodes 25*a*, 25*b*, 25*c*, and 25*d* via a resistor 27 (27*a*, 27*b*, 27*c*, and 27*d*), respectively. The resistors 26 and 27 also are provided on the same side of the base 21.

In addition, on the one side of the base 21, a third electrode 28 for supplying a signal and a first electrode 24*d* serving as a ground are formed. In addition, the cathode of the varactor diode 23*a* located at the feeding end side is connected to the third electrode 28 via an impedance matching circuit 30. The impedance matching circuit 30 is composed of an inductive element 30*a* which is connected between the cathode of the varactor diode 23*a* and the third electrode 28 and a capacitive element 30*b* which is connected between the third electrode 28 and the first electrode 24*d*. In addition, the inductive element 30*a* and the capacitive element 30*b* are provided on the same side of the base 21. In addition, the inductive element 30*a* is not always necessary. In other words, when the inductive element is not provided, the cathode of the varactor diode located at the feeding end side may be directly connected to the third electrode 28.

The antenna device having the above-mentioned structure is provided on a circuit board (not shown) in a cellular phone constructed such that the cellular phone can receive terrestrial digital broadcasting (the maximum broadcasting band is in a range of from 470 to 770 MHz). In addition, the third electrode 28 is connected to a receiving circuit of the circuit board, all of the first electrodes 24 are connected to a ground portion of the circuit board, and a tuning voltage is supplied to the second electrode 25 from the circuit board side. In this case, the second electrode 25 (25*a* to 25*d*) may be connected to each other at the circuit board side and may be directly supplied with the tuning voltage from the circuit board side, but the second electrodes 25 may be supplied with the tuning voltage superimposed on the signal via the third electrode 28.

To receive the frequency range, a total length of the radiating conductors 22 is set to an electrical length resonated with the lowest frequency (470 MHz), that is, ¼λ, and in this condition, the total length is divided in six parts corresponding to the radiating conductors 22*a* to 22*f*. In addition, the capacitance value of each varactor diode 23 is changed in the range of from 2 pF to 22 pF by the tuning voltage.

Figure 3:
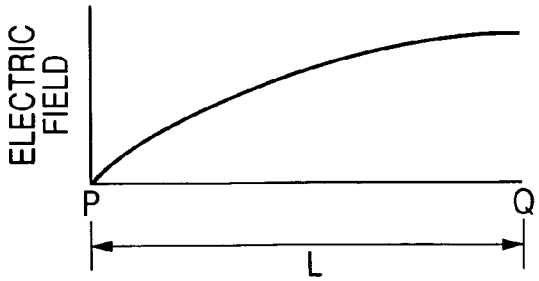
FIG. 3 is an electric field distribution diagram of the antenna device of the present invention.
Figure 4:
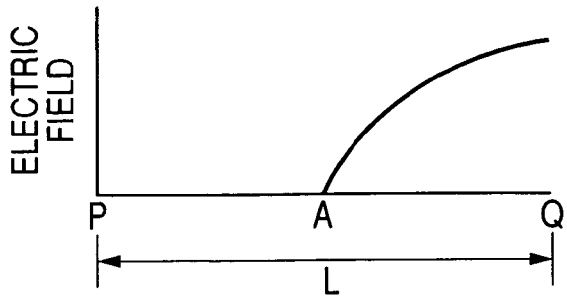
FIG. 4 is another electric field distribution diagram of the antenna device of the present invention.
Figure 5:
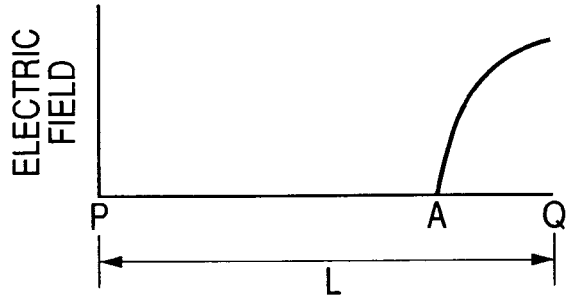
FIG. 5 is another electric field distribution diagram of the antenna device of the present invention.
Figure 6:
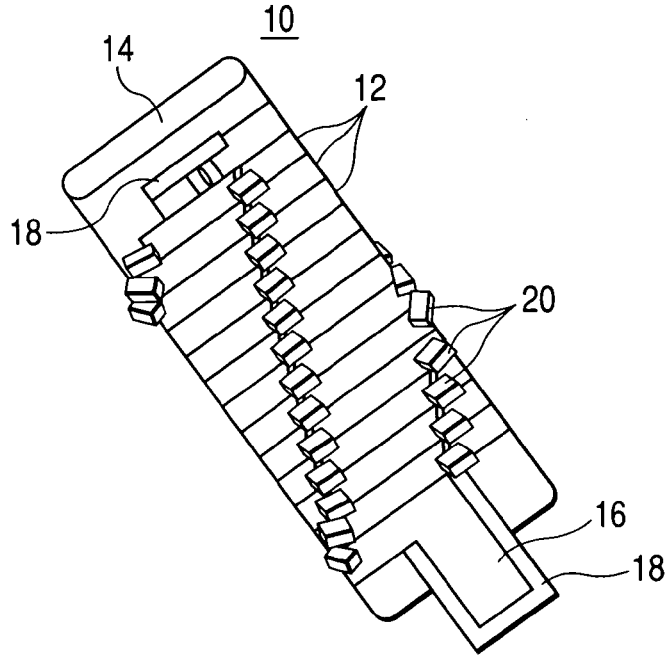
FIG. 6 PRIOR ART
FIG. 6 is a perspective diagram of an antenna device of a conventional art.
Figure 7:
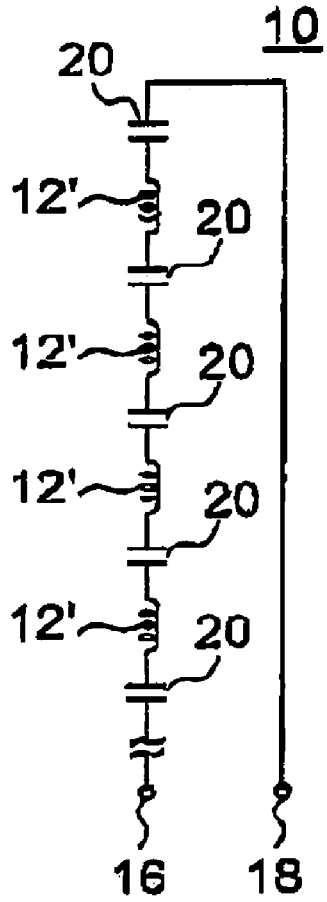
FIG. 7 PRIOR ART
FIG. 7 is an equivalent circuit diagram of the antenna device of the conventional art.

Since the antenna device having the above-mentioned structure has one open end, the maximum electric field is generated at the releasing end side. However, according to an experiment, it is confirmed that as the capacitance value of the varactor diode 23 becomes smaller, a location, at which the electric field becomes the smallest, is moved to the releasing end side. This aspect is shown in FIGS. 3 to 5. FIG. 3 shows an aspect of the electric field generated in the antenna device when the capacitance value of the varactor diode 23 is the greatest. In FIG. 3, a horizontal axis L is a length of the antenna device and is specifically a distance from the location of the feeding end side varactor diode 23*a* (shown as a feeding end P) to the location of the releasing end side radiating conductor 22*f* (shown as a releasing end Q). In addition, in this case, since the capacitance value of the varactor diode 23 is large, the impedance of the varactor diode 23 becomes smaller with respect to each radiating conductor 22. As a whole, the radiating conductors are regard as one radiating conductor and the location at which the electric field becomes the smallest is substantially aligned with the feeding end P.

FIG. 4 shows an aspect of the electric field generated in the antenna device when the capacitance value of the varactor diode 23 is small. In FIG. 4, the location A at which the electric field becomes the smallest is moved to the releasing end Q side. In addition, in this case, it is confirmed that the electric field is not generated between the feeding end P and the location A at which the electric field becomes the smallest. As a result, it is apprehended that the radiating conductors 22 and the varactor diodes 23 located between the releasing end Q and the location A at which the electric field becomes the smallest serve as a line path of ¼λ with respect to the frequency at that time and the radiating conductors 22 and the varactor diodes 23 between the feeding end P and the location A at which the electric field becomes the smallest serve as a simple optical transmission path.

FIG. 5 shows an aspect of the electric field generated in the antenna device when the capacitance value of the varactor diode 23 is further small. In FIG. 5, the location A at which the electric field becomes the smallest is further moved to the releasing end Q side. In addition, also in this case, it is confirmed that the electric field is not generated between the feeding end P and the location A at which the electric field becomes the smallest. As a result, it is apprehended that the radiating conductors 22 and the varactor diodes 23 located between the releasing end Q and the location A at which the electric field becomes the smallest serve as a line path of ¼λ with respect to the frequency at that time and the radiating conductors 22 and the varactor diodes 23 between the feeding end P and the location A at which the electric field becomes the smallest serve as a simple optical transmission path.

As described above, the location at which the electric field becomes the smallest is further moved by the capacitance value of the varactor diode, and the electric field between the location at which the electric field becomes the smallest and the location of the releasing end becomes the greatest at the releasing end. In addition, since the electric field is not generated at the locations from the location at which the electric field becomes the smallest to the feeding end, the antenna device performs the same operation as a monopole antenna.

What is claimed is:

1. An antenna device comprising:

an elongated base made of a dielectric material or a magnetic material;

a radiating conductor divided into a plurality of radiating conductors wound around the base; and a plurality of variable capacitive elements corresponding in number to the plurality of the radiating conductors, wherein the radiating conductors and the variable capacitive elements are alternatively arranged on the base and are coupled to each other in series, the radiating conductor having one end coupled to the variable capacitive element serves as an opening side and the variable capacitive element having its one end connected to the radiating conductor being a signal feeding side, and wherein capacitance values of the variable capacitive elements increase or decrease in the same direction.

2. The antenna device according to claim 1, wherein the base has a prism shape, and the variable capacitive elements are disposed on the same side of the base.

3. The antenna device according to claim 2, wherein each variable capacitive element has a varactor diode;

a first electrode serving as a ground, a second electrode to which a tuning voltage is, appliable and a third electrode for supplying a signal are disposed on a circumferential portion of the same side of the base; and an anode of the varactor diode is coupled to the first electrode via a first resistor, a cathode of the varactor diode is coupled to the second electrode via a second resistor, the varactor diode has one end of its feeding side coupled to the radiating conductor while the other end of the feeding side is coupled to the third electrode, and the first and second resistors are disposed on the same side of the base.

4. The antenna device according to claim 3, wherein a matching circuit is disposed between the third electrode and the other end of the feeding side of the varactor diode.

5. The antenna device according to claim 3, wherein the anodes and cathodes of two the varactor diodes are connected in common to the radiating conductor, a central point of the radiating conductor connected in common to the anodes is coupled to the first electrode via the first resistor, and a central point of the radiating conductor connected in common to the cathodes is coupled to the second electrode via the second resistor.

6. The antenna device according to claim 4, wherein the matching circuit has the capacitive element disposed on the same side of the base; and the capacitive element is disposed between the first and third electrodes.

7. The antenna device according to claim 1, wherein the number of the radiating conductors is six.

* * * * *